US005925613A

United States Patent [19]

Shinomiya et al.

[11] Patent Number: 5,925,613

[45] Date of Patent: Jul. 20, 1999

[54] ALKALINE DEGREASING SOLUTION AND DEGREASING METHOD EMPLOYING THE SAME

[75] Inventors: Mitsuo Shinomiya, Hirakata; Minoru Ishida, Sakai; Shoji Shiraishi, Sanda; Tamotsu Sobata, Ibaraki, all of Japan

[73] Assignee: Nippon Paint Co., Ltd., Osaka, Japan

[21] Appl. No.: 08/645,685

[22] Filed: May 14, 1996

Related U.S. Application Data

[30] Foreign Application Priority Data

May 19, 1995 [JP] Japan ..... 7-121909

[51] Int. Cl.[6] ..... C11D 1/722; C11D 3/08

[52] U.S. Cl. ..... 510/421; 510/201; 510/202; 510/220; 510/232; 510/245; 510/254; 510/365; 510/466; 510/486; 510/511; 510/413; 510/289

[58] Field of Search ..... 510/201, 202, 510/220, 232, 245, 254, 365, 421, 466, 486, 511, 413, 289

[56] References Cited

U.S. PATENT DOCUMENTS

| | | | |
|---|---|---|---|
| 3,983,078 | 9/1976 | Collins | 252/540 |
| 4,683,008 | 7/1987 | Betts | 134/27 |
| 4,965,014 | 10/1990 | Jeschke et al. | 252/174.22 |
| 5,240,633 | 8/1993 | Ahmed et al. | 252/99 |
| 5,423,997 | 6/1995 | Ahmed et al. | 252/99 |
| 5,516,451 | 5/1996 | Schmitt et al. | 252/174.21 |

FOREIGN PATENT DOCUMENTS

| | | |
|---|---|---|
| AO282921 | 3/1988 | European Pat. Off. . |
| AO541034 | 2/1992 | European Pat. Off. . |

OTHER PUBLICATIONS

Patent Abstracts of Japan, unexamined applications, vol. 12, No. 56 Feb. 19, 1988, Patent Office Japanese Government and JP–A–62 199 787 (Nippon Paint Co., Ltd.).

*Primary Examiner*—Mark Kopec
*Assistant Examiner*—Charles Boyer
*Attorney, Agent, or Firm*—Townsend & Banta

[57] ABSTRACT

An alkaline degreasing solution containing 0.01 to 3 g/l of alkali silicate calculated as Si concentration, and 0.01 to 10 g/l of a nonionic surfactant having an HLB value (=20×Mw/M, where Mw represents the weight of a hydrophilic group part and M represents the molecular weight of the surfactant) of 5 to 11 and a structure being expressed in the following general formula (I), with a pH value of at least 9.5:

$$R—O—(EO)_m(AO)_nH \quad (I)$$

where R represents alkyl group, EO represents ethylene oxide group, AO represents alkylene oxide group (propylene oxide group and/or butylene oxide group), m represents an addition molar number of EO which is an integer of 3 to 7, n represents an addition molar number of AO which is an integer of 1 to 6, and m and n satisfy the relation of $n<m\leqq 3n$.

1 Claim, 2 Drawing Sheets

ALKALINE DEGREASING SOLUTION AND DEGREASING METHOD EMPLOYING THE SAME

BACKGROUND OF THE INVENTION

1. Field of the Invention

The present invention relates to a degreasing solution and a degreasing method for degreasing surfaces of metal materials such as iron, zinc and aluminum, and non-metal materials such as plastic.

2. Description of the Background Art

In the field of metal surface treatment or the like, a degreasing treatment is generally performed on an object for removing fat and oil such as mineral oil and animal and vegetable oils adhering to its surface, as a pretreatment for chemical conversion through phosphating or the like. A degreasing agent employed for such a degreasing treatment generally contains a builder which is mainly composed of acid or alkali and a nonionic or anionic surfactant as its main component. While an alkali builder which is mainly composed of phosphate or silicate has been generally employed in consideration of detergency, an alkali builder which is mainly composed of silicate is recently employed by preference, since phosphate causes enrichment of lakes and marshes or the like. An alkali builder which is prepared by further blending silicate with carbonate or the like is also employed.

While a nonionic or anionic surfactant is employed as described above, a nonionic surfactant is generally employed since an anionic surfactant has high foamability.

An HLB value is generally known as a value indicating the characteristics of the nonionic surfactant. This HLB value indicates the balance between the hydrophilic and hydrophobic groups of the surfactant, and the number of hydrophilic group which is contained in the surfactant increases as the HBL value increases. In case of alkaline-degreasing a metal surface or the like, a nonionic surfactant having a high HLB value is generally employed. This is because the detergency increases with the HLB value, and a nonionic surfactant having an HLB value of at least 12 is generally employed in a conventional alkaline degreasing agent. However, a nonionic surfactant having a high HLB value, which has a strong foaming tendency in general, is generally employed together with a defoaming agent having a low HLB value.

In such a conventional degreasing agent, however, oil such as mineral oil, machine oil or spindle oil which is mixed into the degreasing solution by alkaline degreasing form an extremely stable emulsion, due to the action of the surfactant. Consequently, the degreasability of the surfactant disadvantageously extremely reduces when the concentration of the oil which is mixed into the degreasing agent increases.

Particularly when alkaline degreasing is performed under a condition of sufficiently stirring and mixing the degreasing agent, a stable emulsion is readily formed by the surfactant and the mixed oil, to cause such a problem that the mixed oil is not separated but the oil contamination resistance reduces. An example of such a stirring method is a supervibration stirring method which is disclosed in Japanese Patent Publication No. 6-71544 (1994). This supervibration stirring method is adapted to set diaphragms in a degreasing treatment vessel and vibrate the same under conditions of prescribed vibration width, frequency etc. thereby vibrating and stirring a degreasing solution which is stored in the degreasing treatment vessel, for example. When a degreasing treatment is performed by such a supervibration stirring method with a conventional alkaline degreasing solution, however, an extremely fine and stable emulsion is formed and oil cannot be readily separated from water after alkaline degreasing.

SUMMARY OF THE INVENTION

An object of the present invention is to provide an alkaline degreasing solution having excellent degreasability and extremely low foamability with excellent oil contamination resistance and an alkaline degreasing method employing the same.

The alkaline degreasing solution according to the present invention contains 0.01 to 3 g/l of alkali silicate calculated as Si concentration, and 0.01 to 10 g/l of a nonionic surfactant having an HLB value (=20×Mw/M, where Mw represents the weight of a hydrophilic group part and M represents the molecular weight of the surfactant) of 5 to 11 and a structure being expressed in the following general formula (I), with a pH value of at least 9.5:

$$R—O—(EO)_m(AO)_nH \quad (I)$$

where R represents alkyl group, EO represents ethylene oxide group, AO represents alkylene oxide group (propylene oxide group and/or butylene oxide group), m represents an addition molar number of EO which is an integer of 3 to 7, n represents an addition molar number of AO which is an integer of 1 to 6, and m and n satisfy the relation of $n<m \leqq 3n$.

In the above general formula (I), R represents alkyl group preferably having a carbon atom number of 8 to 20, more preferably 8 to 12. If the carbon atom number of the alkyl group represented by R is small, there is such a tendency that the hydrophilic part reduces and surface activity as well as degreasability lower. If the carbon atom number of the alkyl group represented by R increases, on the other hand, oil-water separability tends to reduce.

The HLB value of the nonionic surfactant which is employed in the alkaline degreasing solution according to the present invention is 5 to 11. If the HLB value reduces, the degreasability reduces, the surfactant strongly tends to shift to an oil phase, and the consumed volume of the surfactant increases.

In the general formula (I), m represents the addition molar number of EO, which is an integer of 3 to 7. If m is less than 3, the degreasability tends to reduce. If m exceeds 7, on the other hand, there is such a tendency that the foamability increases, oil-water separability deteriorates and oil contamination resistance reduces.

In the general formula (I), n represents the addition molar number of AO, which is an integer of 1 to 6. If n is less than 1, i.e., zero, there is such a tendency that the foamability increases, oil-water separability deteriorates, and oil contamination resistance reduces. If n exceeds 6, on the other hand, there is such a tendency that the degreasability reduces, the surfactant readily shifts to an oil phase in oil-water separation, and the concentration of the surfactant in a water phase reduces. Specific examples of AO (alkylene oxide) are propylene oxide and butylene oxide.

In the general formula (I), m and n are in a relation satisfying $n<m3n$. If m is not more than n, there is such a tendency that the degreasability reduces, oil-water separability deteriorates, the surfactant readily shifts to an oil phase in oil-water separation, and the concentration of the surfactant in a water phase reduces. If m exceeds 3n, on the other hand, there is such a tendency that the foamability increases, oil-water separability deteriorates and oil contamination resistance reduces.

The concentration of the alkali silicate which is employed in the inventive alkaline degreasing solution is 0.01 to 3 g/l, preferably 0.01 to 1 g/l calculated as Si concentration. There is such a tendency that the degreasability is insufficient if the concentration of alkali silicate serving as an alkali builder is too low, while the oil-water separability deteriorates and oil contamination resistance reduces if the concentration of alkali silicate is too high.

The pH value of the inventive alkaline degreasing solution is at least 9.5, and preferably in the range of 10.5 to 12.5. If the pH value is too low, degreasability tends to reduce. If the pH value is too high, on the other hand, there is an apprehension of corroding aluminum or zinc which is a nonferrous metal material.

The alkaline degreasing solution according to the present invention can be employed in an ordinary degreasing method, and can degrease an object by dipping, spraying, or a solution contact method consisting of a combination thereof. The inventive alkaline degreasing solution is useful particularly in case of performing alkaline degreasing with sufficient stirring and mixing, in an alkaline degreasing method employing a supervibration stirring method of setting diaphragms in a treatment vessel and vibrating the same for stirring a treatment solution which is stored in the treatment vessel, for example.

A degreasing method according to a first aspect of the present invention is adapted to dip an object in an alkaline degreasing solution which is stored in a degreasing treatment vessel for alkaline-degreasing the same, by employing the aforementioned alkaline degreasing solution according to the present invention and alkaline-degreasing the object while stirring the alkaline degreasing solution stored in the degreasing treatment vessel by vibrating diaphragms which are set in the degreasing treatment vessel.

According to the alkaline degreasing method of the first aspect of the present invention, the diaphragms which are set in the degreasing treatment vessel are vibrated, thereby vibrating and stirring the alkaline degreasing solution stored in the degreasing treatment vessel. With such diaphragms, the alkaline degreasing solution is preferably stirred to cause a continuous wave motion having a wave height of at least 0.5 cm, for example, on the surface of the alkaline degreasing solution which is stored in the degreasing treatment vessel. The wave height of such a wave motion of the alkaline degreasing solution is more preferably in the range of 1.0 to 3.0 cm. The term "wave height" indicates the height of waves with respect to a reference solution surface in a still standing state, and the wave height of at least 0.5 cm, for example, is the height of waves causing a wave motion of at least +0.5 cm with respect to the reference solution surface. Such a wave height can be measured by setting a scale or the like in the vicinity of the surface of the degreasing solution which is stored in the degreasing treatment vessel, for example.

In the first aspect of the present invention, the vibration of the diaphragms which are set in the degreasing treatment vessel can be provided by transmitting vibration of a vibrating motor to the diaphragms, for example. A vibration stirrer which is disclosed in Japanese Patent Publication No. 6-71544 (1994) or Japanese Patent Laying-Open No. 6-28779 (1994) can be employed as such a vibration stirrer. The vibration conditions for the diaphragms, which are properly set in response to the shape and the dimensions of the diaphragms, the number and the positions of such diaphragms, the dimensions of the treatment vessel and the like, can be set in the ranges of a frequency of 200 to 600 vtm and a vibration width of 5 to 20 mm, for example.

The inventive alkaline degreasing solution is useful in an alkaline degreasing method which is in a system of still-standing an alkaline degreasing solution after degreasing, separating oil from water, removing oil which is mixed into the cleaning solution by alkaline degreasing, and thereafter employing the solution for alkaline degreasing again.

An alkaline degreasing method according to a second aspect of the present invention comprises the steps of dipping an object in a degreasing treatment vessel storing the aforementioned alkaline degreasing solution according to the present invention for degreasing the same, introducing the alkaline degreasing solution from the degreasing treatment vessel into an oil-water separation vessel after degreasing, separating emulsified oil from the alkaline degreasing solution in the oil-water separation vessel, and returning the alkaline degreasing solution to the degreasing treatment vessel after separation of the oil in the oil-water separation vessel.

In the alkaline degreasing method according to the second aspect, the step of dipping the object in the alkaline degreasing solution for degreasing the same may be a step of alkaline-degreasing the object while stirring the alkaline degreasing solution by vibrating diaphragms which are set in the degreasing treatment vessel by the aforementioned supervibration stirring method of the first aspect.

In the second aspect, further, the alkaline degreasing solution which is stored in the degreasing treatment vessel may be temporarily moved into another vessel such as a preliminary vessel after degreasing, so that the same is thereafter introduced into the oil-water separation vessel.

The alkaline degreasing solution according to the present invention has excellent degreasability, and extremely low foamability. Therefore, it is not necessary to employ another nonionic surfactant, such as the conventional nonionic surfactant, having a low HLB value for serving as a defoaming agent.

Further, the alkaline degreasing solution according to the present invention exhibits remarkably excellent oil-water separability as compared with the conventional alkaline degreasing solution. Therefore, oil which is mixed in alkaline degreasing can be readily separated and removed, whereby the degreasability of the alkaline degreasing solution can be maintained over a long period. Thus, the inventive alkaline degreasing solution is excellent also in oil contamination resistance.

The alkaline degreasing solution, which has excellent degreasability and is excellent in oil-water separability, is useful in an alkaline degreasing method employing a supervibration stirring method, for example.

In the alkaline degreasing method according to the first aspect of the present invention, the aforementioned alkaline degreasing solution of the present invention is employed for alkaline-degreasing the object while stirring the alkaline degreasing solution by vibrating the diaphragms which are set in the degreasing treatment vessel. When the object is alkaline-degreased with the conventional alkaline degreasing solution under such stirring in the supervibration stirring condition, oil which is mixed into the alkaline degreasing solution form a stable emulsion, which in turn remains in the state being mixed into the degreasing solution, such that the oil cannot be readily separated from water. Consequently, the detergency of the alkaline degreasing solution reduces in a short period and the degreasing solution cannot be thereafter used. On the other hand, the alkaline degreasing method according to the first aspect of the present invention employs the aforementioned inventive alkaline degreasing solution which is excellent in degreasability as well as in oil-water separability, whereby oil can be readily separated from water after alkaline degreasing, so that the oil which is mixed into the alkaline degreasing solution can be readily removed. According to the alkaline degreasing method of this aspect, therefore, the alkaline degreasing solution can be repeatedly used over a long period with a long life.

In the alkaline degreasing method according to the second aspect of the present invention, the aforementioned inventive alkaline degreasing solution is employed so that the same is introduced into the oil-water separation vessel after alkaline degreasing. The aforementioned inventive alkaline degreasing solution is excellent in oil-water separability and hence the same can readily separate oil from water in the oil-water separation vessel. Thus, the alkaline degreasing solution from which the mixed oil is removed by oil-water separation can be returned into the degreasing treatment vessel to be reused.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
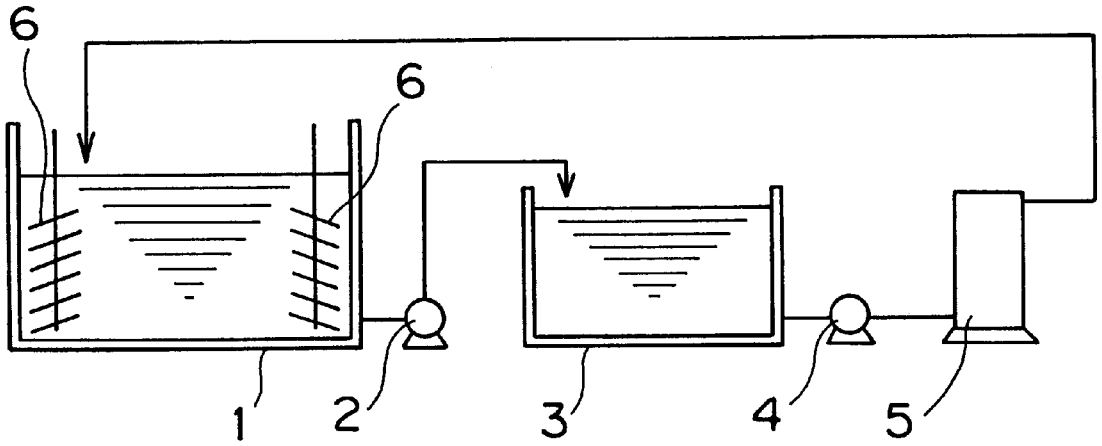
FIG. 1 is a typical diagram showing an exemplary apparatus employed for an alkaline degreasing method according to the present invention.

Nonionic surfactants were prepared from the following surfactants (in the formulas, PO represents propylene oxide):

Example 1: $C_{12}H_{25}O(EO)_5(PO)_{3.5}H$

Example 2: sec-$C_{10}H_{21}O(EO)_5(PO)_{3.5}H$

Example 3: $C_{18}H_{37}O(EO)_6(PO)_2H$

Comparative Example 1: $C_9$—($C_6H_4$)—$O(EO)_{8.5}H$

Comparative Example 2: $C_9$—($C_6H_4$)—$O(EO)_6(PO)_2H$

Comparative Example 3: $C_{12}H_{25}O(EO)_{10}(PO)_2H$

Comparative Example 4: $C_{12}H_{25}O(EO)_{10}(PO)_6H$

Comparative Example 5: ($C_6H_5$)—$C(CH_3)_2$—($C_6H_4$)—$O(EO)_8H$

The concentrations of the surfactants were set at 1.5 g/l. Alkali builders containing 0.1 g/l, 0.5 g/l, 2.0 g/l and 3.0 g/l of sodium metasilicate (alkali silicate), 4.0 g/l of trisodium phosphate, 6.0 g/l of disodium phosphate, 2.0 g/l of sodium carbonate, 3.0 g/l of sodium bicarbonate and 1.0 g/l of sodium nitrite were employed. As to sodium metasilicate, alkali builders containing the same in four types of concentrations were prepared as described above.

As to alkaline degreasing solution which were prepared in the aforementioned manner, characteristics in degreasing were evaluated on objects of SPCC (cold-rolled steel plates). Under conditions of a degreasing bath temperature of 40° C. and a degreasing time of 1 minute, the degreasing solution was stirred in a degreasing treatment vessel with a propeller at a rotation speed of 300 rpm.

Initial degreasability, foamability and oil contamination resistance of the degreasing solution was evaluated in the following manner:

The initial degreasability was evaluated under the following evaluation criteria, by degreasing the objects, thereafter showering the same with tap water at room temperature for 30 seconds, and measuring the water-wetting area percentage:

TABLE 1

| Evaluation | Water-wetting area percentage (%) |
|---|---|
| ○ | 100 |
| ○~ Δ | at least 95 - less than 100 |
| Δ | at least 80 - less than 95 |
| X | less than 80 |

The foamability was evaluated under the following evaluation criteria, by driving the degreasing solution which was diluted to 1/10 with a spray cleaning apparatus at room temperature for 5 minutes and measuring the heights of bubbles from the solution surfaces in an apparatus tank immediately after stoppage of driving.

TABLE 2

| Evaluation | Height of Bubbles from Solution Surface in Tank(cm) |
|---|---|
| X | at least 10 |
| Δ | at least 5 - less than 10 |
| ○ | less than 5 |

The oil contamination resistance was evaluated under similar evaluation criteria to the above, by mixing 10 g/l of rustproof oil ("NP Oil AR-1" (trade name) by Nippon Paint Co., Ltd.) into the degreasing solution, thereafter stirring the same by Disper at 40° C. for 10 minutes, thereafter leaving the same at 40° C. for 10 minutes, thereafter removing oil floating on the degreasing solution, degreasing the objects with the remaining degreasing solution, and measuring the initial degreasability levels.

Table 3 shows the results of the aforementioned evaluation with the HLB values of the respective surfactants. As to the alkali silicate concentrations, "0.01 to 1.0 g/l" is based on data of 0.1 g/l and 0.5 g/l, "1.0 to 3.0 g/l" is based on data of 2.0 g/l, and "at least 3.0 g/l" is based on data of 5.0 g/l respectively.

TABLE 3

| | Surface Active Agent | HLB | Foam-ability | Initial Degreasability Alkali Silicate Concentration (g/l) 0.01–1.0 | 1.0–3.0 | at least 3.0 | Oil Contamination Resistance Alkali Silicate Concentration (g/l) 0.01–1.0 | 1.0–3.0 | at least 3.0 |
|---|---|---|---|---|---|---|---|---|---|
| Example 1 | $C_{12}H_{25}O(EO)_5(PO)_{3.5}H$ | 7.2 | ○ | ○ | ○ | ○ | ○ | ○ | Δ |
| Example 2 | sec-$C_{10}H_{21}O(EO)_5(PO)_{3.5}H$ | 7.6 | ○ | ○ | ○ | ○ | ○ | ○ | Δ |
| Example 3 | $C_{18}H_{37}O(EO)_6(PO)_2H$ | 8.1 | ○ | ○~Δ | ○~Δ | ○ | ○~Δ | ○~Δ | X |
| Comparative Example 1 | 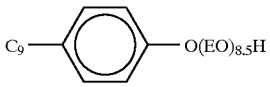 | 12.6 | X | ○ | ○ | ○ | X | X | X |
| Comparative Example 2 | 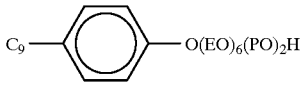 | 8.8 | Δ | ○ | ○ | ○ | ○~Δ | Δ | X |
| Comparative Example 3 | $C_{12}H_{25}O(EO)_{10}(PO)_2H$ | 11.9 | X | ○ | ○ | ○ | X | X | X |
| Comparative Example 4 | $C_{12}H_{25}O(EO)_{10}(PO)_6H$ | 9.0 | ○ | ○~Δ | ○~Δ | ○ | Δ | Δ | X |
| Comparative Example 5 | 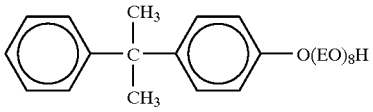 | 12.5 | Δ | ○ | ○ | ○ | ○ | Δ | X |

As clearly understood from Table 3, the alkaline degreasing solution according to Examples 1 to 3 of the present invention are excellent in initial degreasability, with small foamability and excellent oil contamination resistance. As clearly understood from comparative examples shown in Table 3, further, those having low HLB values are generally inferior in initial degreasability, while those having high HLB values have foamability and attain no excellent results in oil contamination resistance, although the same are excellent in initial degreasability.

Supervibration Cleaning

A system of a supervibration cleaning apparatus shown in FIG. 1 was employed to perform alkaline degreasing with the alkaline degreasing solution according to Examples 1 and 2 and comparative examples 1 and 2.

As shown in FIG. 1, the employed supervibration cleaning apparatus system comprises a degreasing treatment vessel 1, a preliminary vessel 3, and an oil-water separation vessel 5. Diaphragms 6 are set in the degreasing treatment vessel 1, so that an alkaline degreasing solution stored in the degreasing treatment vessel 1 can be vibrated and stirred through vibration of the diaphragms 6. The degreasing solution which is stored in the degreasing treatment vessel 1 can be moved into the preliminary vessel 3 by a pump 2. Further, the degreasing solution can be transmitted from the preliminary vessel 3 to the oil-water separation vessel 5 by another pump 4. Oil mixed in the degreasing solution which is transmitted from the degreasing treatment vessel 1 into the preliminary 3 is separated from water to some extent in the preliminary vessel 3, and the degreasing solution is moved into the oil-water separation vessel 5 from a lower portion of the preliminary vessel 3 by the pump 4. The degreasing solution is further stood still and subjected to oil-water separation in the oil-water separation vessel 5, so that the mixed oil is removed and the degreasing solution is returned into the degreasing/treatment vessel 1 again.

The degreasing solution which is stored in the degreasing treatment vessel 1 is subjected to oil-water separation through the aforementioned operation, to be repeatedly used.

Figure 2:
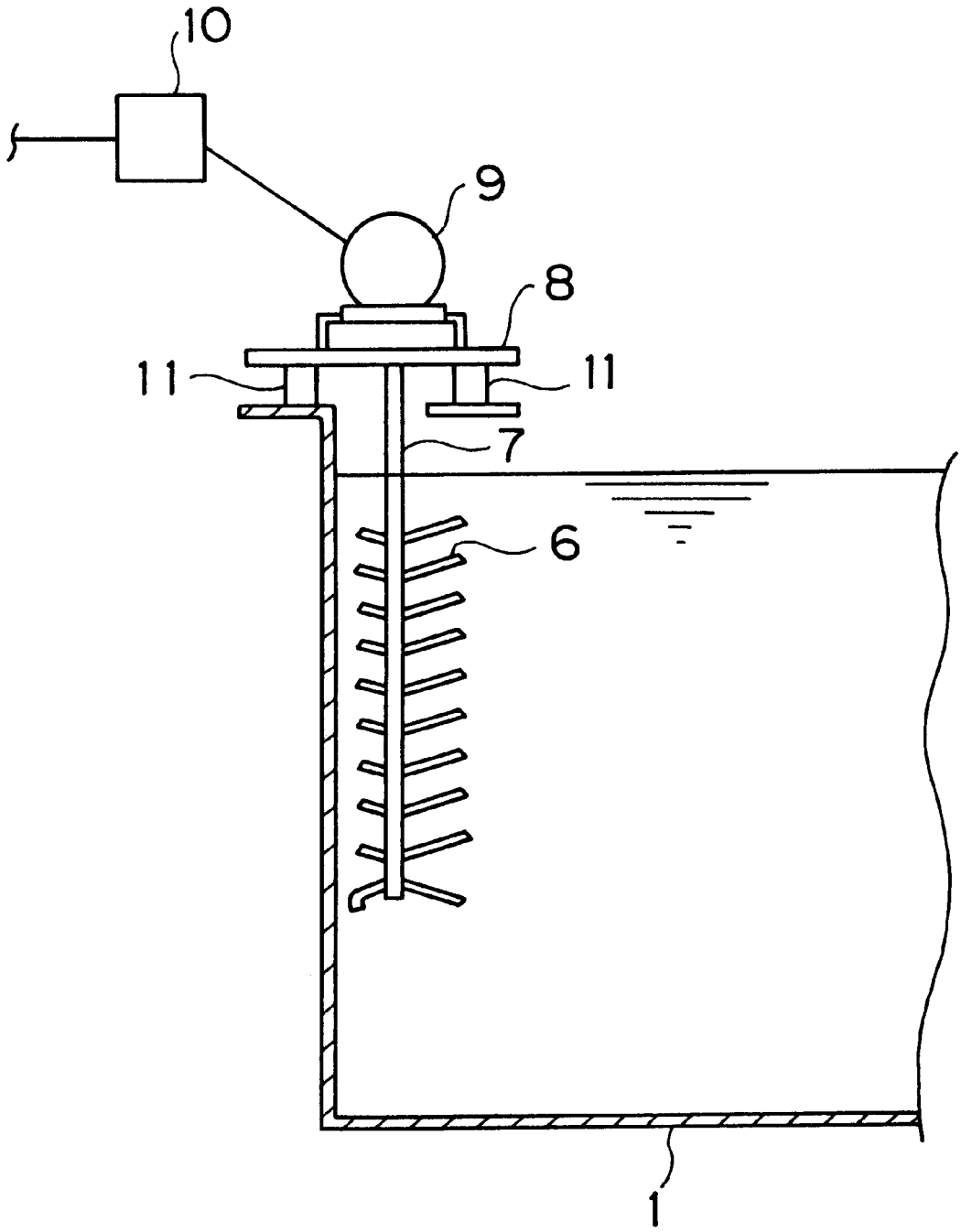
FIG. 2 is an enlarged sectional view showing a portion of the apparatus appearing in FIG. 1 around diaphragms.

FIG. 2 is an enlarged sectional view showing a portion around the diaphragms 6. As shown in FIG. 2, the diaphragms 6 are mounted on a vibration bar 7, the upper end of which is mounted on a vibration plate 8. The vibration plate 8 is supported by a cushion member 11, to be vibrated at a prescribed frequency with a prescribed vibration width by vibration of a vibration motor 9. The vibration motor 9 is vibrated by power from an invertor 10, and this vibration is supplied to the vibration plate 8, so that the diaphragms 6 provided in the degreasing treatment vessel 1 are vibrated through the vibration bar 7. The vibration motor 9 is prepared from that of 150 W, for example. The supervibration apparatus shown in FIG. 2 is prepared from a supervibration stirrer ("α-2 type Stirrer" (trade name) by Nihon Techno Co. Ltd.,), for example.

The apparatus shown in FIGS. 1 and 2 was employed to perform alkaline degreasing with the aforementioned alkaline degreasing solution according to Examples 1 and 2 and comparative examples 1 and 2. Each degreasing solution had an alkali silicate concentration of 1.0 g/l as $Na_2SiO_3$. Objects were prepared from the above SPCC with application of large quantities of oil, and subjected to a continuous degreasing treatment through the aforementioned apparatus. After performing the degreasing treatment for a prescribed time, equilibrium concentrations of emulsified oil contained in the degreasing solution stored in the degreasing treatment vessel and degreasability values at this point of time were evaluated under the aforementioned evaluation criteria. Table 4 shows the results.

TABLE 4

| | Example 1 | Example 2 | Comparative Example 1 | Comparative Example 2 |
|---|---|---|---|---|
| Equilibrium Oil Concentration (ppm) | 2700 | 2800 | 11000 | 5600 |
| Degreasability | ○ | ○ | X | Δ |

It is clearly understood from Table 4 that the degreasing solution according to Examples 1 and 2 of the present invention have low equilibrium oil concentrations and excellent oil-water separability, as well as excellent degreasability.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An alkaline degreasing solution containing 0.01 to 1 g/l of alkali silicate calculated as Si concentration, and 0.01 to 10 g/l of a nonionic surfactant having an HLB value of 5 to 11 and a structure being expressed in the following general formula (I), with a pH value in the range of 10.5 to 12.5:

$$R—O—(EO)_m(AO)_nH \quad (I)$$

where R represents an alkyl group having a carbon number of 8 to 12, EO represents ethylene oxide group, AO represents alkylene oxide group (propylene oxide group and/or butylene oxide group), m represents an addition molar number of EO being an integer of 3 to 7, n represents an addition molar number of AO being an integer of 1 to 6, and m and n satisfy the relation of $n \leqq m \leqq 3n$.

* * * * *